US005456188A

United States Patent [19]

Lowing

[11] Patent Number: 5,456,188

[45] Date of Patent: Oct. 10, 1995

[54] OPEN-TOP RAIL CAR COVER CONSTRUCTION HAVING BUCKET LIP AND FORKLIFT TINE ENGAGING MEMBERS

[75] Inventor: James A. Lowing, Plymouth, Mich.

[73] Assignee: Michigan Railcar Repair, Inc., Royal Oak, Mich.

[21] Appl. No.: 222,033

[22] Filed: Apr. 4, 1994

[51] Int. Cl.[6] ..... B61D 39/00

[52] U.S. Cl. ..... 105/377.01; 296/100

[58] Field of Search ..... 105/377.01; 296/100; 220/284, 260; 414/411; 294/27.1, 68.1

[56] References Cited

U.S. PATENT DOCUMENTS

| | | | |
|---|---|---|---|
| 1,637,960 | 8/1927 | Romine | 244/68.1 |
| 2,985,118 | 5/1961 | Maharick et al. | 105/377 R |
| 3,504,637 | 4/1970 | Miller | 105/377 R |
| 3,831,792 | 8/1974 | Waterman et al. . | |
| 5,036,775 | 8/1991 | Snead | 105/377 R |
| 5,078,560 | 1/1992 | Patrick et al. | 414/529 X |
| 5,310,073 | 5/1994 | Johannsson | 220/254 |

*Primary Examiner*—Robert J. Oberleitner
*Assistant Examiner*—S. Joseph Morano
*Attorney, Agent, or Firm*—Charles W. Chandler

[57] ABSTRACT

Fabricated metal hooks are attached to the cover of an open top rail car for receiving the lip of a bucket loading apparatus for lifting the cover from the rail car. Each hook has an elongated slot with a lip-receiving opening facing the side of the rail car.

5 Claims, 3 Drawing Sheets

OPEN-TOP RAIL CAR COVER CONSTRUCTION HAVING BUCKET LIP AND FORKLIFT TINE ENGAGING MEMBERS

BACKGROUND OF THE INVENTION

The invention is related to a cover construction for an open top railroad car. The cover has lifting structure such that it can be removed from a rail car by either a front end loader, or a rear or back loader.

Open-top rail cars, such as gondola cars, hoppers and grain cars are employed to transport waste, coal, grain and similar materials that may tend to blow out of the car. A cover is commonly mounted on the open top to contain the car's contents.

U.S. Pat. No. 3,831,792 which was issued Aug. 27, 1974 to Fred W. Waterman et al. for "Railroad Car Construction" illustrates apparatus for raising a hinged cover from a moving rail car.

covers of some rail cars are constructed to permit various lifting devices to either remove or mount the cover on a stationary car. For example, an eye is commonly attached to the center of the cover so that a crane having a hook can engage the eye and raise or lower the cover. Some covers have a pair of side openings which receive the prongs of a fork lift truck which remove the cover from the rail car.

However, such apparatus is not readily available at some locations where the rail cars are loaded. For example, when the rail car is employed to transport contaminated soil or other waste, the available equipment may be a front end loader or a back loader which removes the waste from the ground. Fabricated hooks have been mounted along the side edges of the cover for receiving the front lip of a front end loader bucket. The lip of the bucket is inserted into two or three spaced hooks and the bucket then raised to lift the cover.

Where the lip has several metal teeth, the teeth tend to damage the hooks and the cover.

SUMMARY OF THE INVENTION

The broad purpose of the present invention is to provide an improved side-receiving hook construction for a rail car cover to assist a bucket-loading device in lifting the cover.

The preferred embodiment of the invention employs three slotted hooks, spaced along the cover's side edge. Each hook has a tubular base and a raised slot which opens to the side of the rail car. The base extends generally at right angles to the side edge of the cover. Preferably, rectangular tubing is employed having a height of 4" and a width of 2". The 4" height permits the shovel's lip to be inserted in the slot while providing sufficient clearance for teeth mounted along the lip to clear the cover surface.

A pair of parallel side plates are welded to the opposite vertical sides of the base. The side plates are cut to form the throat of the slot. The outer ends of the slot guide the bucket lip into the slot. The base is anchored to the cover frame to provide structural rigidity as the cover is being lifted.

Preferably, a similar set of hooks are mounted along the opposite side edge of the cover so the cover can lifted by a vehicle located on either side of the car.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
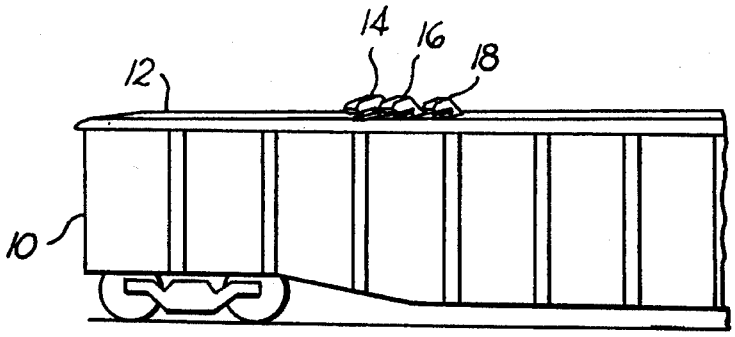
FIG. 1 illustrates a rail car with a cover having fabricated hooks illustrating the preferred embodiment of the invention.
Figure 2:
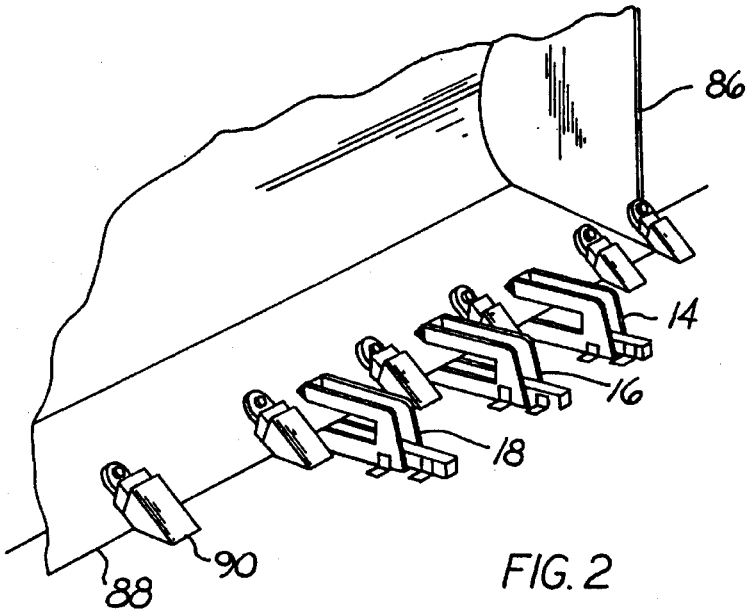
FIG. 2 is a fragmentary view illustrating a bucket lip being inserted into the hooks.

Referring to the drawings, FIG. 1 illustrates a conventional open-top rail car 10 having a cover 12 with a construction illustrating the preferred embodiment of the invention. Car 10 has two such covers, one mounted at the forward end and the other at the rear end of the car. The car may have more or less covers.

Figure 3:
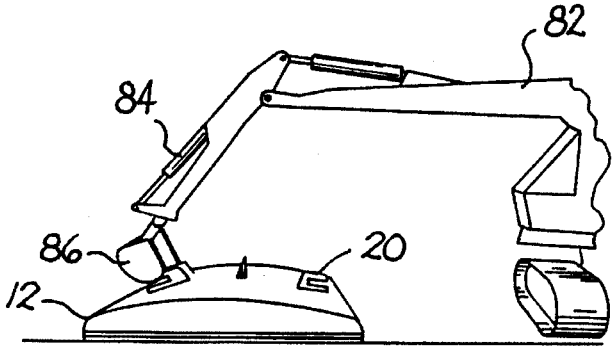
FIG. 3 is a view of a loading device laying the cover on the ground.

Elongated side opening hooks 14, 16 and 18 are mounted on cover 12. The three hooks are attached adjacent the side edge of the cover and spaced a distance of about 18" between the centerlines of adjacent hooks. A second group 20 of three hooks is mounted adjacent the opposite side edge of the car, as illustrated in FIG. 3, so that the cover can be lifted by a vehicle located on either side of the car.

The structure of the hooks is identical. A typical hook 18, illustrated in FIGS. 5–7, has a tubular base 22 having a rectangular cross section. The base is a steel tube 4"×2" installed so the upper surface of the base is about 4" above the top of the rail car cover.

Figure 5:
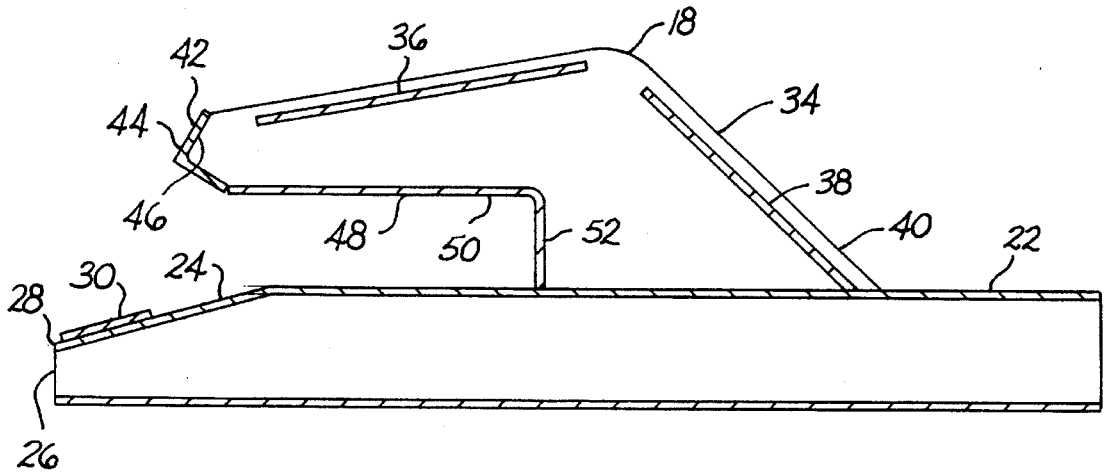
FIG. 5 is an enlarged sectional view of a typical hook.

As best illustrated in FIG. 5, one end of base 22 is cut along a line 24 beginning about a point 6" from end 26 to taper the end of the base down to about 1¾". A plate 28 is welded to the opposite top edges of the base, and a second plate 30 is welded on top of plate 28 adjacent its outer edge. Both plates 28 and 30 span the upstanding sides of the base. Base 30 has a width of about 3" as viewed in FIG. 5 and measured along the top side edges to which it is welded.

A pair of side plates 32 and 34 have their lower edges welded to base 22. A pair of plates 36 and 38 are welded to the side plates to form a body. The right hand edge of plates 32 and 34, as viewed in FIG. 5, forms an angle of about 45° with respect to tubular body 22. The opposite edge 42 of the two plates is cut at about a 45° angle. The two side plates are welded to a structural 45° angle 44 which has its corner facing toward the left, as viewed in FIG. 5, which would be toward the side edge of the cover. Angle 44 points in a direction generally parallel to the longitudinal axis of tubular body 22 and cooperates with plates 24 and 30 to form a converging opening 46. Opening 46 opens into a slot 48 defined in part by a plate 50 which has its side edges welded to plates 32 and 34.

Plate 50 is bent with a length about 10¼" to form an upper shovel-engaging surface of the slot, parallel to base 22. The slot has a height of about 3" above base 22. The right hand edge of plate 50 is bent down at 52 to form a closed end for the slot.

Figure 4:
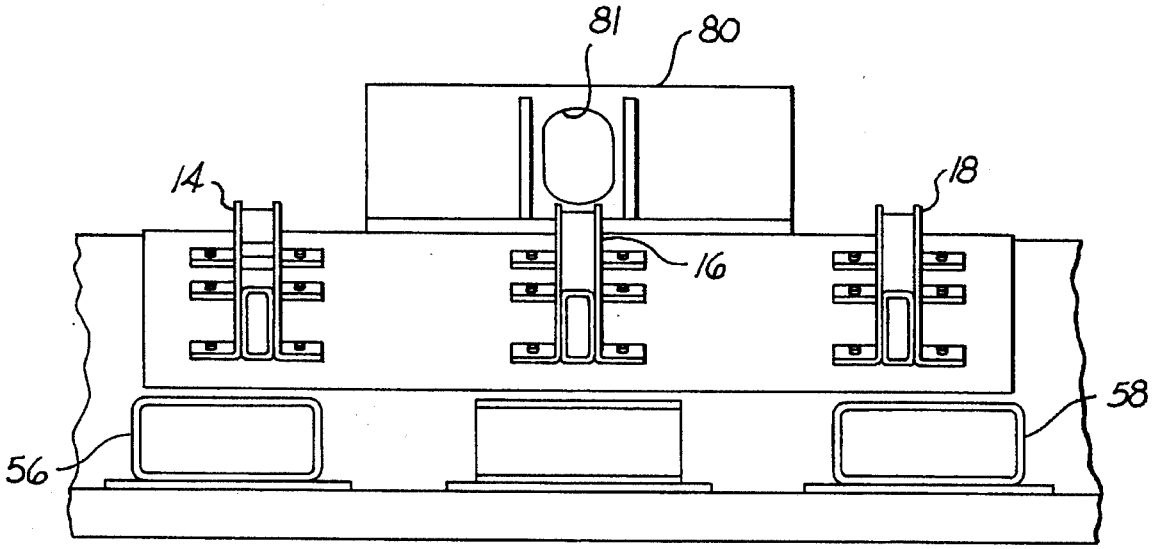
FIG. 4 is an enlarged side view of the hooks.
Figure 6:
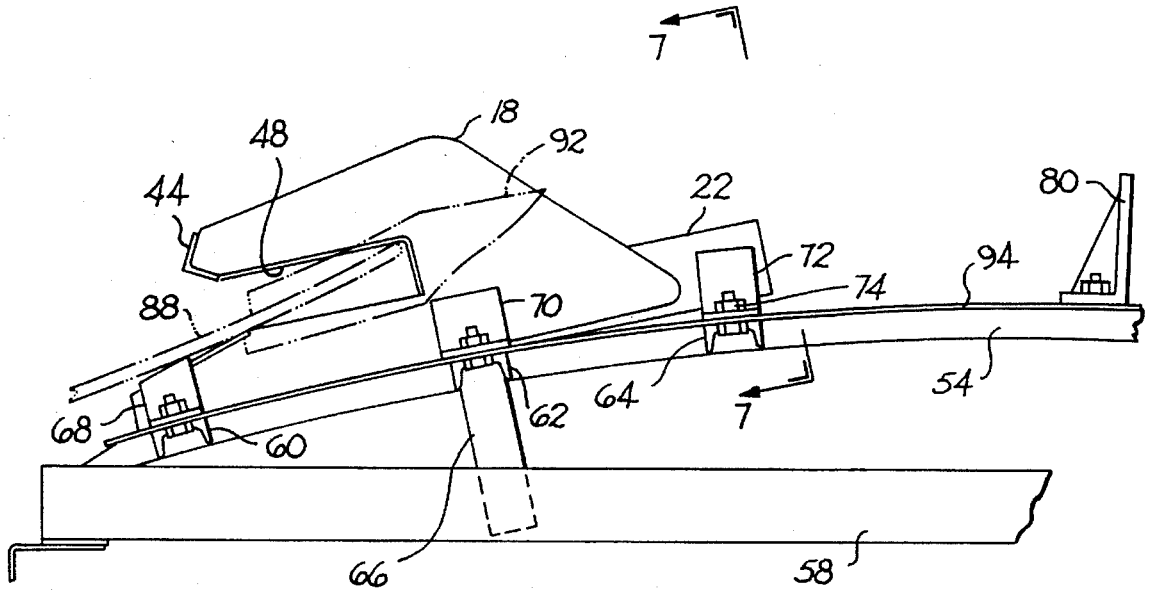
FIG. 6 is a side view of a hook mounted on the cover illustrating the manner in which the bucket lip is inserted into the hook slot.

Cover 12 has a structural steel frame 54 which includes a pair of tubular members 56 and 58, as best illustrated in FIGS. 4 and 6. Tubular members 56 and 58 have open ends adapted to receive the prongs of a fork-lift truck. The hooks are each mounted over a pair of longitudinally running channels 60 and 62 which form a part of the cover frame. A third channel 64 is attached to the frame beneath the upper end of body 22. A steel reinforcing member 66 has its upper end attached to the frame and its lower end welded to tubular members 56 and 58.

Figure 7:
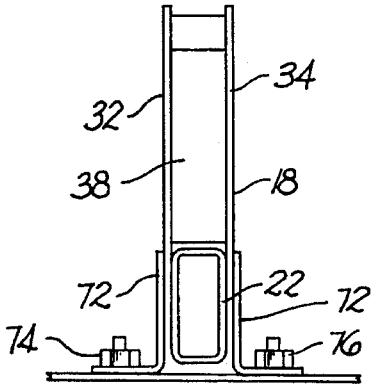
FIG. 7 is a view generally as seen along lines 7—7 of FIG. 6.

Three pairs of brackets 68, 70 and 72 are welded to the base as illustrated in FIG. 6. One bracket of each pair is on the near side of the base as illustrated, the opposite bracket being aligned with but on the far side of the base. Each bracket has a right angle configuration as illustrated in FIG. 7, the vertical leg being welded to the body and the horizontal leg being connected by fastener means 74 and 76 to the channel disposed beneath the particular pair of brackets.

The hooks can be anchored to other structural cover members, since not all covers have a fork lift truck prong receiving structure.

In use, a tracked loading apparatus 82 having a powered articulated arm 84 carries a bucket 86 in the manner well known to those skilled in the art. The bucket has a linear lip 88 with a plurality of spaced, steel digging teeth 90 fastened along the lip. Each tooth 90 projects both above and below the lip. FIG. 6 illustrates the outline of a typical tooth 92 attached to bucket lip 88, and the manner in which the bucket lip is inserted into slot 48. The lip is guided into the slot by angle 44 and plate 24. When it is fully inserted in the slot, the lip edge contacts wall 52. The top surface of base 22 is supported a sufficient distance above the cover's sheet material 94 so the teeth clear the cover. When the lip swings up to engage the upper corner of the slot, the bottom surface of the lip then engages plates 24 and 30.

The loading apparatus may be either a front end loader, or a rear loader.

The distance between the upper corner of the slot, and plates 24 and 30 provides the shovel sufficient leverage to raise the cover from the rail car and then to the lower the cover to the ground, as illustrated in FIG. 3. When the rail car has either been emptied or filled as the case may be, the process is reversed.

FIGS. 4 and 6 illustrate a central lifting eye 80 having an opening 81, attached to the cover's frame along its longitudinal axis. The eye may take a variety forms so long as it provides means for a hook lowered from a crane to engage the eye to lift the cover.

Having described my invention, I claim:

1. A rail car cover construction adapted to engage a waste loading bucket having digging teeth along a lip, for lifting the cover, comprising:

cover frame means;

sheet material attached to the frame means to form a generally rectangular cover having a side edge and adapted to be mounted on an open top rail car to at least partially cover the interior of the car;

hook means mounted on the cover adjacent said side edge, and means attaching the hook means to the cover frame means, the hook means including a plurality of hook members spaced in a direction parallel to the side edge of the cover, each hook member having a body with an upper arm and a lower base spaced to form a slot for receiving the lip of a loading bucket, the slot having an opening facing toward the side edge of the cover;

the slot being elongated in a direction generally at right angles to the side edge of the cover;

the base having a bucket-engaging surface spaced above the cover sheet material a distance sufficient to permit a tooth carried on the bucket lip and extending below the bucket lip, to clear the cover material as the bucket lip is being received in the slot; and the hooks being disposed adjacent the longitudinal mid-section of the cover so the cover is generally balanced as it is being lifted by the bucket.

2. A rail car cover construction as defined in claim 1, in which the slot has generally parallel shovel-engaging surfaces, parallel to the surface of the cover.

3. A rail car cover construction as defined in claim 1, in which the cover frame means includes a pair of spaced parallel tubular members having open ends adjacent the side edge of the cover for receiving the horizontal lifting prongs of a fork-lift truck, and the hooks are anchored to the tubular members.

4. A rail car cover construction as defined in claim 1, in which each hook has a generally elongated tubular base, means for attaching the base to the cover frame means, the tubular base extending at right angles to the side edge of the cover, the base having a tapered end adjacent the cover edge, and a shovel-engaging plate attached to the tapered end to form a generally convergent opening for the slot.

5. Apparatus for covering or uncovering the top of an elongated railroad car, comprising:

a mobile bucket loading vehicle having a ground-engaging means;

articulated arm means carried by the vehicle;

a waste loading bucket carried by the articulated arm means so as to be moveable with respect to the vehicle between a lower ground-engaging position, and an upper position adjacent the top of a railroad car, the bucket having an elongated lip and a series of spaced digging teeth attached to and along the lip;

removable elongated cover means mounted on the top of the railroad car and having a side edge generally parallel to the longitudinal axis of the railroad car;

hook means mounted on the cover means adjacent said side edge;

the hook means including a plurality of hook members spaced in a direction parallel to the side edge of the cover, a distance less than the length of the bucket lip to collectively engage the lip, each hook member having a body with an upper arm and a lower base forming a slot having an opening facing toward the side edge of the cover means for receiving the lip of the loading bucket as the loading bucket is moved in a direction at right angles to the length of the railroad car;

a bucket-engaging plate mounted adjacent the slot opening of each of said hook members, the plate being spaced above the cover means a distance sufficient to permit a digging tooth carried on the bucket lip and extending below the bucket lip to clear the cover means as the bucket lip is being received in the slot; and the hook members being disposed adjacent the longitudinal midsection of the cover means so the elongated cover means is generally balanced as it is being lifted by the bucket.

* * * * *